United States Patent [19]

Barrash

[11] 4,269,314

[45] May 26, 1981

[54] ELASTIC BAND AND HANDLE STRUCTURE FOR FORMING PACKAGES OF GROUPS OF CONTAINERS

[75] Inventor: Marshall J. Barrash, Atlanta, Ga.

[73] Assignee: The Coca-Cola Company, Atlanta, Ga.

[21] Appl. No.: 65,421

[22] Filed: Aug. 10, 1979

[51] Int. Cl.[3] ..... B65D 71/08; B65D 75/56; B65B 61/14; B65D 85/62

[52] U.S. Cl. ..... 206/428; 206/150; 229/52 AL; 53/441

[58] Field of Search ..... 206/150, 428, 434, 497; 229/52 AL, DIG. 12; 53/441

[56] References Cited

U.S. PATENT DOCUMENTS

| | | | |
|---|---|---|---|
| 2,884,328 | 4/1959 | Johnson | 219/DIG. 12 |
| 3,013,655 | 12/1961 | Brody | 206/428 |
| 3,557,516 | 1/1971 | Brandt | 229/52 AL |
| 3,656,614 | 4/1972 | Jacobson | 229/DIG. 12 |

*Primary Examiner*—William T. Dixson, Jr.
*Attorney, Agent, or Firm*—Birch, Stewart, Kolasch & Birch

[57] ABSTRACT

A combined elastic endless band and integral handle strap for defining and carrying multiple container package configuration is provided in which the handle strap is loosely associated with the endless band in an unstretched condition of the latter and flush with the said endless band in a stretched condition of the latter.

10 Claims, 4 Drawing Figures

ELASTIC BAND AND HANDLE STRUCTURE FOR FORMING PACKAGES OF GROUPS OF CONTAINERS

FIELD OF THE INVENTION

This invention relates to packaging groups of containers and more particularly, to elastic banding means in combination with an integral handle structure for maintaining groups of containers such as cylindrical beverage cans in predetermined packaged groups.

BACKGROUND OF THE INVENTION

In the prior art, bottles and cans have been prepackaged in six-pack configurations by shrink films such as illustrated in U.S. Pat. No. 3,217,874 to Potter, issued Nov. 16, 1965, in which the plastic sheet or tube which is shrink fitted to the six-pack includes finger grips or the like for the purpose of carrying that six-pack.

Another type of packaging for six-packs or other prearranged groupings of containers is by way of elastic bands with or without the additional expedient of elastic neck or container top engaging matrices shaped in accordance with the desired formation of the six-pack or other multiples of containers. Such an arrangement is illustrated in FIG. 19 of U.S. Pat. No. 3,714,756 of MacInnes et al, issued Feb. 6, 1973. This patent also illustrates suitable mechanism by which an elastic band may be placed around a group of containers to maintain that group in a predetermined multicontainer package shape. The additional neck engaging portion of the package is illustrated in FIG. 19 of MacInnes as including finger holes for the purpose of transporting the package from place to place.

It is an object of the present invention to provide a package banding structure for packages of multiple containers which include either two forms of container holding devices such as illustrated in the MacInnes patent or which are merely arranged in groups of six or twelve of the like and held only by the banding device around the vertical sides of the containers, the said elastic banding structure including an integral handle means of novel construction.

Still another object of the present invention is to provide a new and novel elastic banding structure for packaging groups of containers in which a handle means is integrally affixed to the banding device such that when the banding device is stretched, the handle will be in a relatively unstressed condition lying flat against the stretched elastic band.

These and other objects of the present invention will become more fully apparent with reference to the following specification and drawings which relate to a preferred embodiment of the present invention.

SUMMARY OF THE INVENTION

The elastic banding device of the present invention includes a continuous elongated web or ribbon of elastic material, such as, for example, polyethylene film or similar plastic materials which is sized such that when it is stretched it will slip over a group of containers such as six cans, twelve cans, or the like and when released, will exert an inward and uniform pressure around the group of containers or cans to provide a multi-container package thereof. Affixed to the outside surface of the endless loop of web or ribbon material is a strap shaped handle of equal or lesser width having two ends glued or otherwise affixed to the outer surface of the endless loop or web such that when in an unstretched condition of the endless loop, the handle is bowed outwardly with respect to the endless loop surface, the two ends of the strap-shaped handle being closer together in the unstretched condition of the endless loop than the longitudinal extent of the strap shaped handle. Then, when the endless loop is stretched to a size sufficient to slip over a group of containers, the handle will have its ends moved farther apart to the extent that it will lie flat against the ultimate package and the outer surface of the endless loop. This way, the handle may be grasped and stretched from its relatively unstressed flush position against the stressed or stretched endless web to a stressed position caused by exerting a force against the handle sufficient to carry the group of containers held in the package configuration by the said endless web.

In an illustrated preferred embodiment of the present invention, the group of containers can be one or more six packs or cans or the like held together at their tops by stretch loops or matrices as known in the prior art. Thus, a pair of six packs can be bound together in a twelve pack configuration by a single endless stretch band and integral handle assembly of the present invention or twelve cans or six cans or other groups of cans can be packaged solely by the use of the endless stretch band and handle without the additional top-engaging matrices.

DETAILED DESCRIPTION OF THE DRAWINGS

Figure 1:
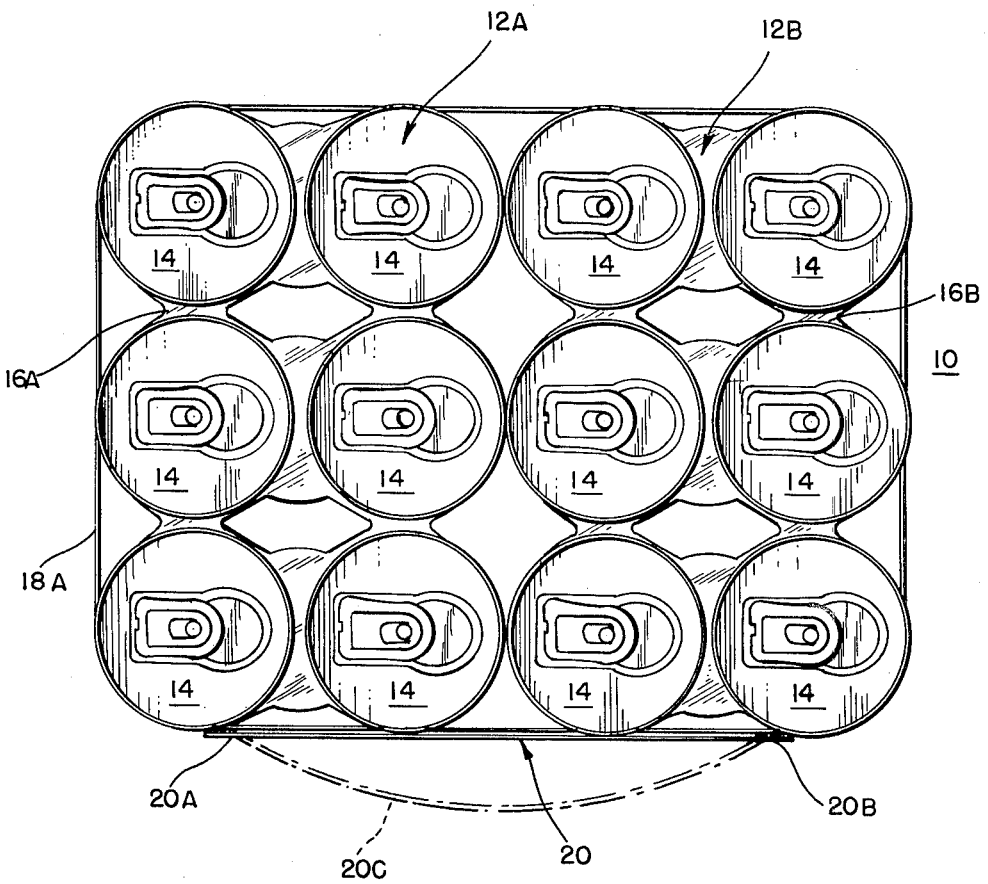
FIG. 1 is a top-plan view of two six packs including top engaging stretch matrices with a single endless stretch band combining them into a twelve pack configuration with an integral handle.
Figure 2:
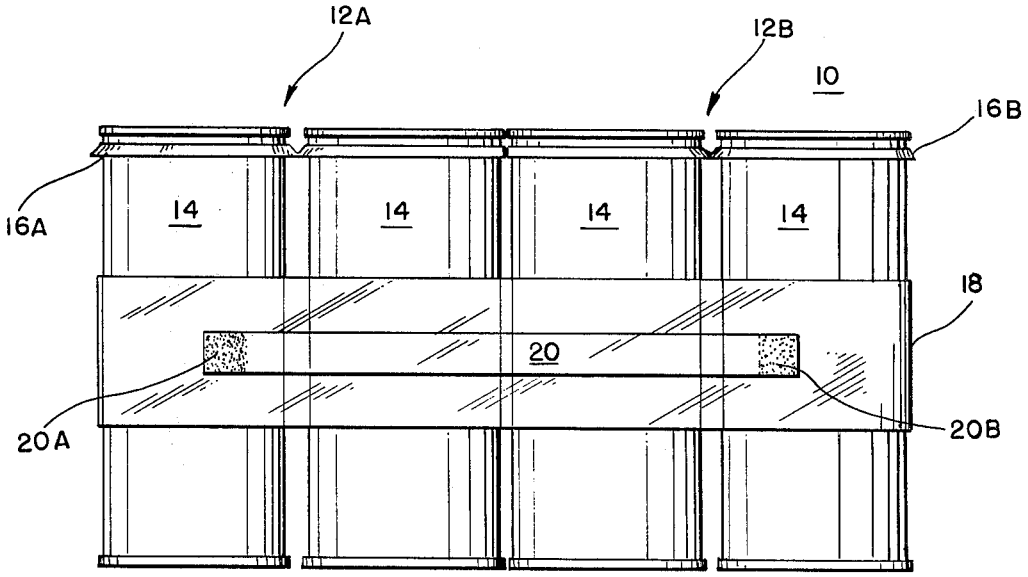
FIG. 2 is a side elevation of the dual six pack configuration of FIG. 1.

Referring in detail to the drawings and with particular reference to FIGS. 1 and 2, a multi-container package 10 consisting of two six-packs 12A and 12B of containers such as cans 14 are shown as being defined by first and second elastic loop matrices 16A and 16B, respectively.

The two six-packs 12A and 12B of containers 14 are joined together in a unitary multi-container package by means of a circumferential elastic band 18, which is formed in an endless configuration from a web or ribbon of elastic materials and envelops and grips the vertical sides of the cans or containers 14 to securely bind the two six-packs together in a single package unit.

An integral handle strap 20 extends along one side of the multi-container package 10 flush with the surface of the endless stretch band 18 and comprised of a similar material. The handle strap 20 includes bonded areas 20A and 20B at opposite ends thereof which maintain the handle strap bonded to the outer surface of the endless band 18.

As illustrated in FIG. 1, the handle strap 20 is moved from its solid line position, which is its quiescent position, to a dotted line position 20C when gripped to provide a handle for the multi-container package 10. The position 20C is assumed by the handle strap 20 due to the stretchability of the material from which the handle strap 20 is fabricated, this material being substantially identical to the material from which the endless band 18 is fabricated.

Figure 3:
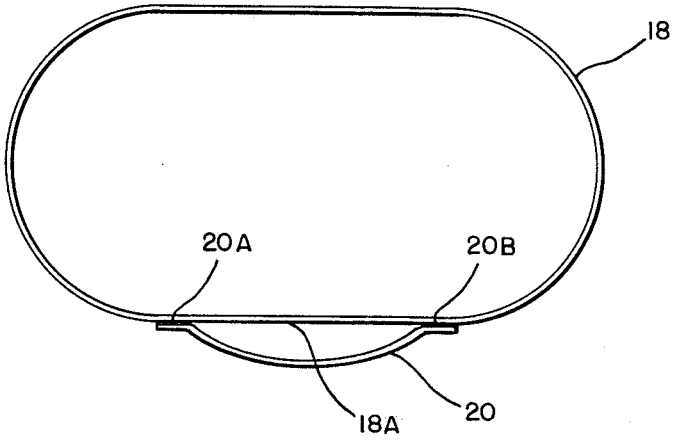
FIG. 3 is a top view of an unstretched endless band and handle prior to its application to a container package.
Figure 4:
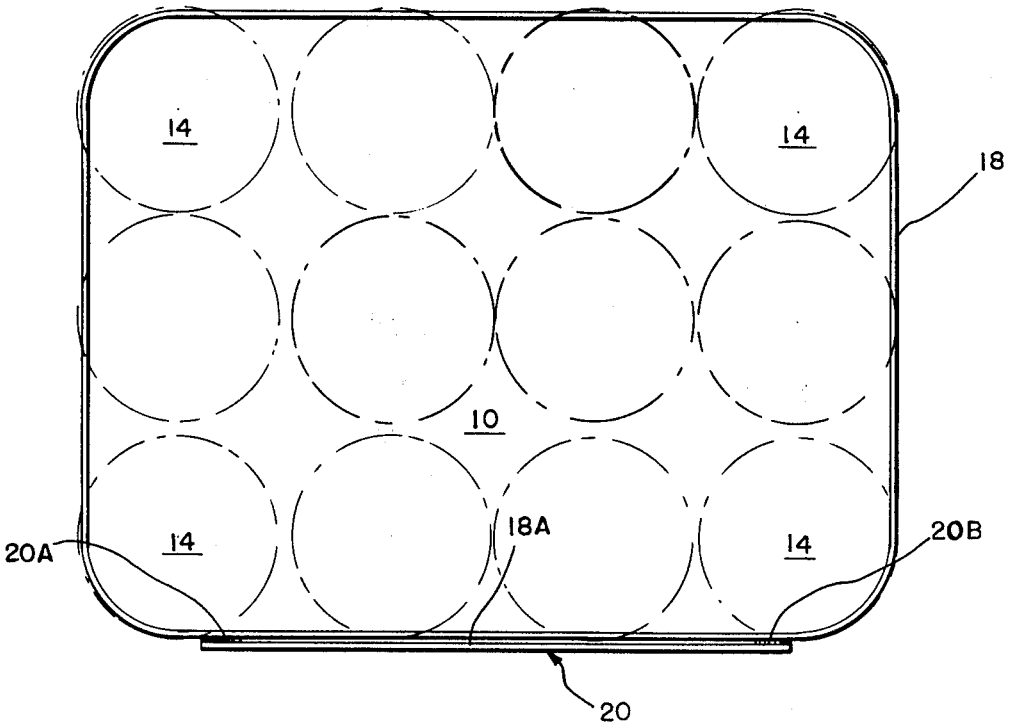
FIG. 4 illustrates the stretched band and handle schematically placed upon a multi-container package with the handle lying flush against the stretched band.

To further illustrate the structure and configuration of the endless band 18 and integral handle strap 20, reference is now made to FIGS. 3 and 4.

Referring first to FIG. 3, the endless band 18 is shown in a relatively unstretched or unstressed condition such that the side of the band 18 to which the handle strap 20 is attached at the points of bonding 20A and 20B, is in a relaxed state, thereby causing the handle strap 20 to bow outwardly from the outermost surface 18A of the endless band 18 due to the fact that the bonded ends 20A and 20B of the handle strap 20 are closer together than would be the case when the band 18 has been stretched or stressed to fit over a plurality of containers or cans in a multi-container package configuration such as illustrated in FIG. 4, schematically.

In FIG. 4, in its stressed condition, the endless band 18 is shown as having been stretched to move the bonded ends 20A and 20B of the handle strap 20 sufficiently far apart such that the entire handle strap 20 lays substantially juxtaposed along the outer surface 18A of the endless web 18 between the bonded areas 20A and 20B. This is equivalent to the solid line position of the handle strap 20 initially referred to in FIG. 1 and illustrated in a side elevation in FIG. 2.

The number of containers in the can pack or a multi-container package 10 can be any suitable number such as six cans 14, twelve cans 14, etc., or more. Also, these container packages 10 can be provided with or without the top engaging elastic matrices such as 16A and 16B illustrated in FIGS. 1 and 2.

By forming the handle strap 20 and endless band 18 of similar material in the configuration of FIG. 3, the handle strap 20 is held in a straightened out and flush condition without being tensioned thereby permitting an easy stretching and extension of the handle strap for the purpose of carrying the multi-container package while at the same time maintaining the handle strap 20 out of the way during normal handling, stacking and the like.

The ends 20A and 20B of the handle strap 20 may be welded such as by ultrasonics or otherwise suitably bonded to the elastic band 18.

The tape, web or ribbon material of the endless belt 18 may be colored, printed, or otherwise decorated and the handle strap 20 can be made of a contrasting or different color to provide for easy customer identification of the handle. If desired, proof-of-purchase coupons or the like may comprise a portion of the handle strap 20.

The endless tape or band 18 may be initially fabricated by wrapping a tape around a suitable mandrel and causing the ends to be affixed one to the other in the formation of an endless band. Subsequently, similar tape of the same or contrasing color may be applied in a finite length with the ends thereof gapped as illustrated in FIG. 3 for the ends 20A and 20B to provide a relatively loose or looped handle strap 20 on the endless belt or tape 18. Subsequently, the belt or band 18 is placed upon a frame and stretched to the extent indicated in FIG. 4 or slightly greater to be fitted over a multi-container group such that when the frame releases the stretched band 18 it will grip the entire group of containers in a desired multi-container package configuration such as the package 10.

It should be understood that the ELASTIC BAND AND HANDLE STRUCTURE FOR FORMING PACKAGES OF GROUPS OF CONTAINERS may be modified as would occur to one of ordinary skill in the art without departing from the spirit and scope of the present invention.

It is claimed:

1. In combination with an endless band of elastic material for surrounding a package configuration in a stretched and tensioned condition;

an elongated handle strap of finite length extending over substantially a like finite adjacent surface length of said stretched endless band;

said handle strap having first and second ends secured to said endless band and having the surface area intermediate its ends substantially juxtaposed with the adjacent said surface of said endless band;

said handle strap being in substantially unstretched condition when said endless band is in said stretched and tensioned condition; and said handle strap being in a relatively loose and non-juxtaposed condition with respect to said adjacent surface of said endless band when the latter is in an unstretched condition.

2. The invention of claim 1, wherein said handle strap is at least as narrow as said endless band.

3. The invention of any one of claims 1 or 2, wherein said handle strap is of contrasting color to said endless band.

4. The invention of any one of claims 1 or 2, wherein said handle strap includes proof-of-purchase information thereon.

5. Elastic banding means for maintaining at least one group of containers in a multi-container package configuration comprising:

an endless band of elastic material for surrounding and gripping the sides of a multiplicity of containers prearranged in a desired multi-container package configuration of at least one group of containers while said endless band means is in a stretched and tensioned condition;

an elongated handle strap of finite length extending over substantially a like finite adjacent surface length of said stretched endless band;

said handle strap having first and second ends secured to said endless band and having the surface area intermediate its ends substantially juxtaposed with the adjacent said surface of said endless band;

said handle strap being in substantially unstretched condition when said endless band is in said stretched and tensioned condition; and said handle strap being in a relatively loose and non-juxtaposed condition with respect to said adjacent surface of said endless band when the latter is in an unstretched condition.

6. The invention of claim 5, wherein said handle strap is at least as narrow as said endless band.

7. The invention of any one of claim 5 or 6, wherein said handle strap is of contrasting color to said endless band.

8. The invention of any one of claim 5 or 6, wherein said handle strap includes proof-of-purchase information thereon.

9. The invention defined in claim 5 or 6, in combination with a said multiplicity of containers including at least two preformed group of containers;

said endless band encompassing both said groups to define said desired multi-container package configuration.

10. The method of forming a multi-container package defined by a combined endless stretch band and flush handle strap structure from elongated elastic web material comprising:

forming an endless loop of said elastic web material;

forming a handle strap from a finite length of web material of a compatible width to said endless loop and affixing both ends thereof to said endless loop at a distance between said ends of less than said finite length to bow said handle strap away from the adjacent surface of said endless web;

grouping a multiplicity of containers in a multi-container package configuration of a girth compatible with a stretched condition of said endless web and a substantially unstretched but fully extended condition of said handle strap;

stretching said web to its said stretched condition in excess of said girth;

enveloping said configuration with said web; and releasing said web to elastically grip said configuration and maintain said handle strap flush with said web over substantially a like said finite length thereof.

* * * * *